United States Patent [19]

Hafner et al.

[11] 4,119,227

[45] Oct. 10, 1978

[54] AUTOMATIC, CONTINUOUSLY OPERABLE BAG OPENING APPARATUS

[75] Inventors: Hermann Hafner; Otto Steiper, both of Ortenberg, Fed. Rep. of Germany

[73] Assignee: Martin Wendel KG, Buedingen, Fed. Rep. of Germany

[21] Appl. No.: 775,873

[22] Filed: Mar. 9, 1977

[30] Foreign Application Priority Data

Mar. 19, 1976 [DE] Fed. Rep. of Germany ..... 2611591

[51] Int. Cl.[2] ..... B65G 65/04

[52] U.S. Cl. ..... 214/305; 214/308

[58] Field of Search ..... 214/304, 305, 308, 311; 198/766, 417

[56] References Cited

U.S. PATENT DOCUMENTS

| | | | |
|---|---|---|---|
| 1,911,525 | 5/1933 | Neuman | 214/311 |
| 2,271,937 | 2/1942 | Engels | 214/311 |
| 2,664,995 | 1/1954 | Renner | 198/766 |
| 3,756,586 | 9/1973 | Craft | 198/417 |

FOREIGN PATENT DOCUMENTS

| | | | |
|---|---|---|---|
| 2,161,791 | 6/1973 | Fed. Rep. of Germany | 214/305 |
| 106,985 | 6/1965 | Norway | 214/305 |

*Primary Examiner*—Lawrence J. Oresky

*Attorney, Agent, or Firm*—W. G. Fasse; W. W. Roberts

[57] ABSTRACT

The present continuously operable bag opening apparatus has two conveyor belts. The upstream end of each belt is supported on a horizontal drive member. The downstream end of each belt is supported on a respective substantially vertically extending guide roller, whereby the upper runs of the conveyor belts form a downwardly open channel, the belt walls of which converge toward the downstream end of the two conveyors. A rotary knife is arranged between the belts so that a bag which travels on the belts over the knife is cut open and its content falls down though said channel.

7 Claims, 3 Drawing Figures

AUTOMATIC, CONTINUOUSLY OPERABLE BAG OPENING APPARATUS

BACKGROUND OF THE INVENTION

The present invention relates to an automatic, continuously operable bag opening apparatus. Such bag may be made, for example, of paper, plastics material, jute, burlap, and the like, or combinations thereof. Such bags are used for transporting bulk material, such as grains, cement, and the like, and the present apparatus is intended to automatically and continuously remove such materials from the bags for further transporting into a filling funnel, for example, by gravity or by other mechanical or pneumatic conveying means which are not part of the present invention.

Devices for opening bags are known in the prior art as, for example, represented by German Pat. Nos. 1,207,877; 1,221,155; and 1,461,865. Prior art devices of this type comprise two conveying elements arranged alongside each other leaving a gap therebetween for a cutting mechanism. The conveying elements, for example, comprise chains provided with friction increasing means such as points or tips extending away from the chain links. These chains are arranged to extend horizontally or vertically alongside each other to receive the bags therebetween. The bags must be received between the chains in a precisely aligned position, either upright or prone. As the bags travel through the channel between the chains, they retain their original position while they are being emptied through usually quite involved devices. Thus, prior art arrangements have the disadvantage that, for example, only one bag size may travel through the machine and that it becomes necessary to readjust the machine if different bag sizes are to be opened. Such adjustments usually require a substantial amount of time as well as rather involved mechanisms, since a precise alignment and/or a precise channel shape are absolutely necessary.

OBJECTS OF THE INVENTION

In view of the above, it is the aim of the invention to achieve the following objects, singly or in combination:

to simplify the opening and emptying of bags in an automatic and continuous manner by means which are as simple as possible, as well as compact and easily to operate without requiring complicated adjustments;

to provide a mechanism for the opening of bags which will substantially reduce the production of dust as the bags are being emptied;

to automatically and continuously empty the contents of a bag which may be supplied into the machine in any random position, either extending across the conveyor means or length wise therealong, or even at an angle thereto;

to assure that the cut open portions of a bag are tilted toward each other after the cutting operation to facilitage the emptying;

to subject the bags as they are being emptied, to a rocking motion with their cut open portions facing downwardly to further facilitate the emptying; and to subject the bags as they are being moved through the apparatus to a positive entraining action by the conveyor means regardless of the size of the bags.

SUMMARY OF THE INVENTION

According to the invention there is provided an automatic, continuously operable bag opening apparatus, wherein endless conveyor belts have upstream drive rollers arranged substantially horizontally and downstream guide rollers arranged substantially vertically and in parallel to each other, whereby the conveyor belts form, with their upper runs, a conveying channel which converges toward the downstream end and which is preferably provided with spikes for positively entraining bags supplied into the conveying system in any random position.

It is an advantage of the invention that after the cutting open of the bag, the respective portions are tilted upwardly and toward each other to facilitate the emptying. The emptying action may be further improved by continuously shaking or rocking the downstream end of the conveyors, whereby the cut open bags are subjected to an ever increasing shaking or rocking amplitude as they travel away from the center of rotation of the rocking motion toward the exit end downstream of the conveyors. Preferably, strip-off blades are arranged alongside and in parallel to the guide rollers of the conveyor belts and guide means for removing the empty bags may also be arranged at the exit end of the conveyor belts. Due to this combination of features, the bags are simply and rapidly emptied in a safely operating apparatus which is simple and hence not subject to operational troubles. The bags may enter into the apparatus in any random position and/or any random spacing from bag to bag and/or any bag sizes may be handled.

BRIEF FIGURE DESCRIPTION

In order that the invention may be clearly understood, it will now be described, by way of example, with reference to the accompanying drawings, wherein.

Figure 1:
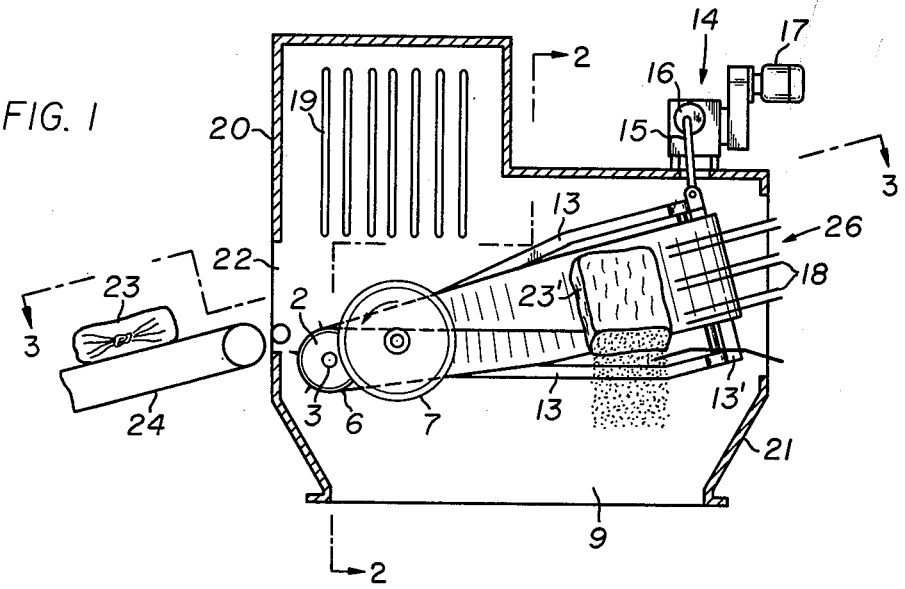
FIG. 1 shows a vertical section through an apparatus, according to the invention, substantially centrally thereof.
Figure 3:
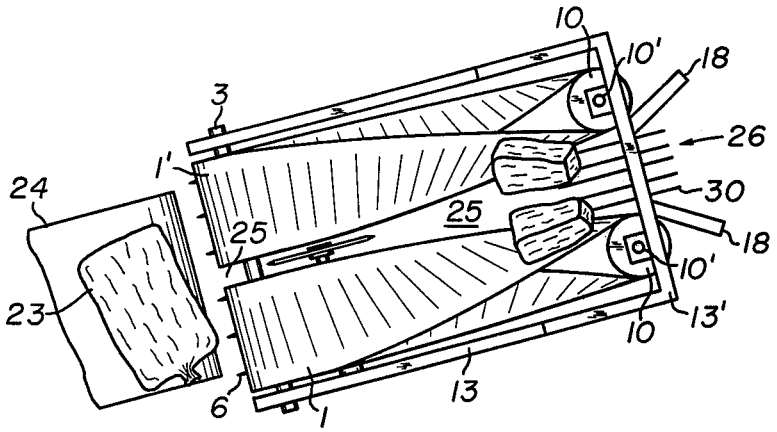
FIG. 3 is a sectional view along the section line 3—3 in FIG. 1, whereby the housing itself has been omitted for simplicity's sake.
Figure 2:
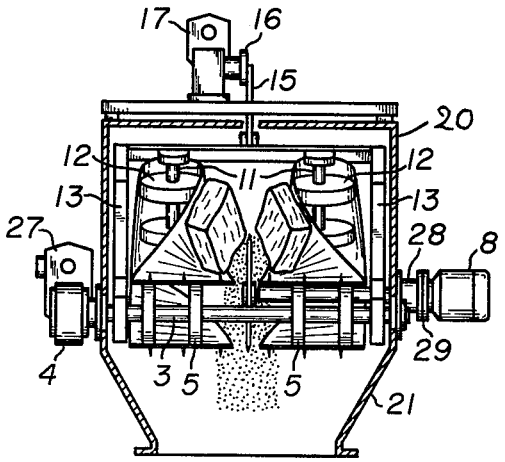
FIG. 2 is a sectional view along the section line 2—2 in FIG. 1.

DETAILED DESCRIPTION OF PREFERRED EXAMPLE EMBODIMENTS:

FIG. 1 comprises a housing 20, the lower end may, for example, be shaped into a funnel exit 21. The housing has an inlet 22 through which the bags 23 may enter into the apparatus, for example, by means of a supply conveyor 24. Inside the housing there are arranged two conveyor belts 1 and 1' running alongside each other and spaced from each other to form a gap 25 between the two conveyors 1 and 1'. The upstream end of the conveyors 1 and 1' adjacent to the inlet opening 22 in the housing 20, is supported by drive rollers 2 having a common rotational axis 3. The downstream end of the conveyor belts 1 and 1' adjacent to the exit 26 are supported by guide rollers 10 having respective rotational axes 10'. Incidentally, the roller 2 may comprise a plurality of discs 5 spaced along the drive shaft 3 which also carries a regulating gear 4 at one end thereof and which is driven by a motor 27.

The conveyor belts 1, 1' are provided with spikes 6 on their surfaces, whereby the spikes 6 are so distributed that bags of different dimensions, especially different lengths will be entrained and taken along by these spikes independently of the position of any particular bag entering the apparatus.

Cutting means such as a rotational knife 7 are arranged in the gap 25 between the feed advance and emptying conveyors 1 and 1'. The rotational knife 7 is driven by a motor 8 through a shaft 28 and a clutch 29.

The guide rollers 10 extend at an angle to the horizontal, whereby these rollers may take up any desired angle. The preferred angle is a 90° angle relative to a plane extending through the drive shaft 3. Preferably, the two rotational axes 10' extend in parallel to each other. However, this is not absolutely necessary for a proper operation of the present apparatus. The guide rollers 10 may also comprise a shaft 11 carrying a plurality of roller discs 12, whereby these shafts 11 are supported in a rocker frame 13, which is journaled at its right hand end about the drive shaft or rotational axis 3. The downstream end 13' of the rocker frame 13 is connected to a vibrating or shaking mechanism 14 by means of a rod 15 and a crank 16 driven by a motor and adjustable gear mechanism 17. By moving the rocker frame 13 substantially up and down, a shaking action is imparted on the cut open bags 23', whereby the content falls down into the funnel opening 9 of the funnel 21. The shaking mechanism 14 is supported on the housing 20 and the outlet opening 26 is sufficient to accommodate the shaking motion.

Strip-off rods or blades 18 are arranged adjacent to the guide rollers 10 so that the empty bag portions may easily be removed from the housing, preferably over guide rods or discs 30.

Inside the housing there may be arranged filter and fan means 19 for collecting any dust that may result from the emptying of the bags.

Although the invention has been described with reference to specific example embodiments, it will be appreciated, that it is intended to cover all modifications and equivalents within the scope of the appended claims.

What is claimed is:

1. An apparatus for automatically and continuously opening bags comprising housing means, conveyor belt means including two conveyor belts arranged alongside each other with a gap therebetween, upstream roller means arranged substantially horizontally for supporting the upstream end of said conveyor belts, downstream roller means arranged at an angle to the horizontal for supporting the downstream ends of said belts, whereby the upper runs of the belts form a channel with converging side walls, knife means arranged in said gap upstream of said channel, whereby bags travelling on said conveyor belts over the knife means are cut open and turned with their still closed ends up to empty through said gap, wherein said downstream roller means (10, 12) have rotational axes (10') extending in parallel to each other, said upstream roller means (2) having a common rotational axis (3) supported in said housing means, said parallel axes (10') of said upstream roller means extending at right angles to a plane which in turn extends through said common rotational axis, said apparatus further comprising rocker frame means (13), journal means supporting one end of said rocker frame means (13) for journalling about said common rotational axis (3), said rotational axes (10') of said downstream roller means (12) being supported in the other end of said rocker frame means (13), and drive means (14) operatively interposed between said housing means and said rocker frame means (13).

2. The apparatus of claim 1, wherein said downstream roller means are arranged to extend substantially vertically, whereby the upper runs of said conveyor belts move toward each other from the upstream end thereof toward the downstream end thereof.

3. The apparatus of claim 1, wherein said drive means comprise crank means and adjustable gear drive motor means for turning said crank means.

4. The apparatus of claim 1, wherein said housing means have a downwardly extending funnel shape.

5. The apparatus of claim 1, further comprising means arranged adjacent to the downstream end of said conveyor means for removing empty bags from the apparatus.

6. The apparatus of claim 5, wherein said removing means comprise stripping rods and outlet guide means.

7. The apparatus of claim 1, wherein said conveyor belt means are provided with spikes or the like.

* * * * *